US005299711A

United States Patent [19]

Romick

[11] Patent Number: 5,299,711

[45] Date of Patent: Apr. 5, 1994

[54] MEDICATION DISPENSING CONTAINER

[76] Inventor: Jerome M. Romick, Artromick International, Inc., 4800 Hilton Corp. Dr., Columbus, Ohio 43232

[21] Appl. No.: 970,863

[22] Filed: Nov. 3, 1992

[51] Int. Cl.[5] ..... G07F 11/00

[52] U.S. Cl. ..... 221/2; 206/534; 215/365

[58] Field of Search ..... 221/268, 2; 206/528, 206/534, 532, 538, 533; 215/365, 366, 367; 220/351, 345

[56] References Cited

U.S. PATENT DOCUMENTS

| | | | |
|---|---|---|---|
| D. 165,856 | 2/1952 | Mytinger . | |
| D. 281,145 | 10/1985 | Moe . | |
| 828,151 | 8/1906 | Upjohn | 220/351 |
| 903,716 | 11/1908 | Healy et al. | 215/367 |
| 1,036,588 | 8/1912 | Eastburn | 215/367 |
| 2,035,340 | 3/1936 | Primavera | 220/345 |
| 2,101,687 | 12/1937 | Paul | 206/538 |
| 2,102,094 | 12/1937 | Romig | 220/41 |
| 2,295,747 | 9/1942 | Mills | 220/41 |
| 2,378,003 | 6/1945 | Duell | 206/538 |
| 2,463,586 | 3/1949 | Anderson | 220/41 |
| 2,708,026 | 5/1955 | Duell | 206/42 |
| 2,777,570 | 1/1957 | Mytinger | 206/42 |
| 3,082,902 | 3/1963 | Kimbrough, Jr. | 220/18 |
| 3,537,422 | 11/1970 | Moe | 116/121 |
| 3,817,372 | 6/1974 | Smith | 206/42 |
| 4,342,403 | 8/1982 | Badtke et al. | 220/345 |
| 4,360,148 | 11/1982 | Forbes, Jr. | 229/43 |
| 4,535,890 | 8/1985 | Artusi | 206/532 |
| 4,569,462 | 2/1986 | Belolin | 222/180 |
| 4,615,461 | 10/1986 | Liu | 220/331 |
| 4,947,989 | 8/1990 | Horton | 206/387 |

*Primary Examiner*—D. Glenn Dayoan
*Assistant Examiner*—Kenneth Noland
*Attorney, Agent, or Firm*—Vorys, Sater, Seymour & Pease

[57] ABSTRACT

A medical dispenser having a container with internal slide channels and a cover with slotted structure for removably receiving indicia bearing cards and structure for providing detenting of such cover.

9 Claims, 3 Drawing Sheets

MEDICATION DISPENSING CONTAINER

BACKGROUND OF THE INVENTION

The present invention relates generally to dispensers and, more particularly, to medication and pharmaceutical containing dispensers having improved indicia carrying capabilities and sliding characteristics.

The prior art contains a wide variety of medical dispensers for tablets, pills and other pharmaceutical preparations. One common type of dispenser construction includes a tray having a generally rectangular configuration dimensioned for storing a plurality of tablets and/or other medical preparations, and a slidable cover cooperating with guideways formed by the tray. Exemplary of such known dispensers are those described in U.S. Pat. Nos.: 828,151; 2,035,340; 2,101,687; 2,102,094; 2,378,003; and 2,777,576. Generally, slidable covers of this type have labels adhesively applied thereto which provide information regarding the contents of the tray and the patient to whom the contents are to be administered. None of the previously existing trays include means for allowing easy insertion, removal, and securement of indicia cards bearing the desired medical information. Moreover, known containers of this general type have laterally extending, shelf-type edges which cooperate with folded edges of the cover portion, allowing the cover to slide back and forth. In practice, however, the folded portions of the cover tends to distort over time thereby making it somewhat difficult to open or close the cover. In addition, such covers are susceptible to being inadvertently knocked off of the tray during handling.

SUMMARY OF THE INVENTION

The present invention provides an improved medical dispenser for storing and dispensing medical preparations. Included in this dispenser is a container formed as a generally parallel piped tray having an open top, and guiding surfaces formed longitudinally on at least along opposing internal marginal sides adjacent the open top. A cover is structured so that it slidably cooperates with the guide surfaces of the container to facilitate its opening and closing. In this embodiment, the slidable cover is provided with a pair of longitudinally spaced apart and raised projections which define recesses that face each other and which are adapted to releasably receive a pliable indicia card member having ends which cooperate with the receiving recesses.

In another illustrated embodiment, the container's guiding structure includes a pair of integral internal channels, and the cover includes a corresponding pair of edge means which cooperate with the channels. In such an embodiment, the cover is provided with detents which cooperate with the container to inhibit undesired opening of the cover.

Accordingly, among the objects which are provided by the present invention are the following: an improved medical dispensing container which has improved indicia carrying capabilities; an improved dispensing container which allows for easy, insertion, retention, and replacement of indicia bearing cards on a slidable cover so as to facilitate reuse of the dispenser; an improved container which inhibits undesired sliding of the cover; and an improved dispenser with a container having internal channels to provide for sustained easy cover sliding action.

Other objects and further scope of applicability of the present invention will become apparent from the detailed description to follow when taken in conjunction with the accompanying drawings in which like parts are designated by like reference numerals throughout the several views.

DETAILED DESCRIPTIONS

Figure 1:
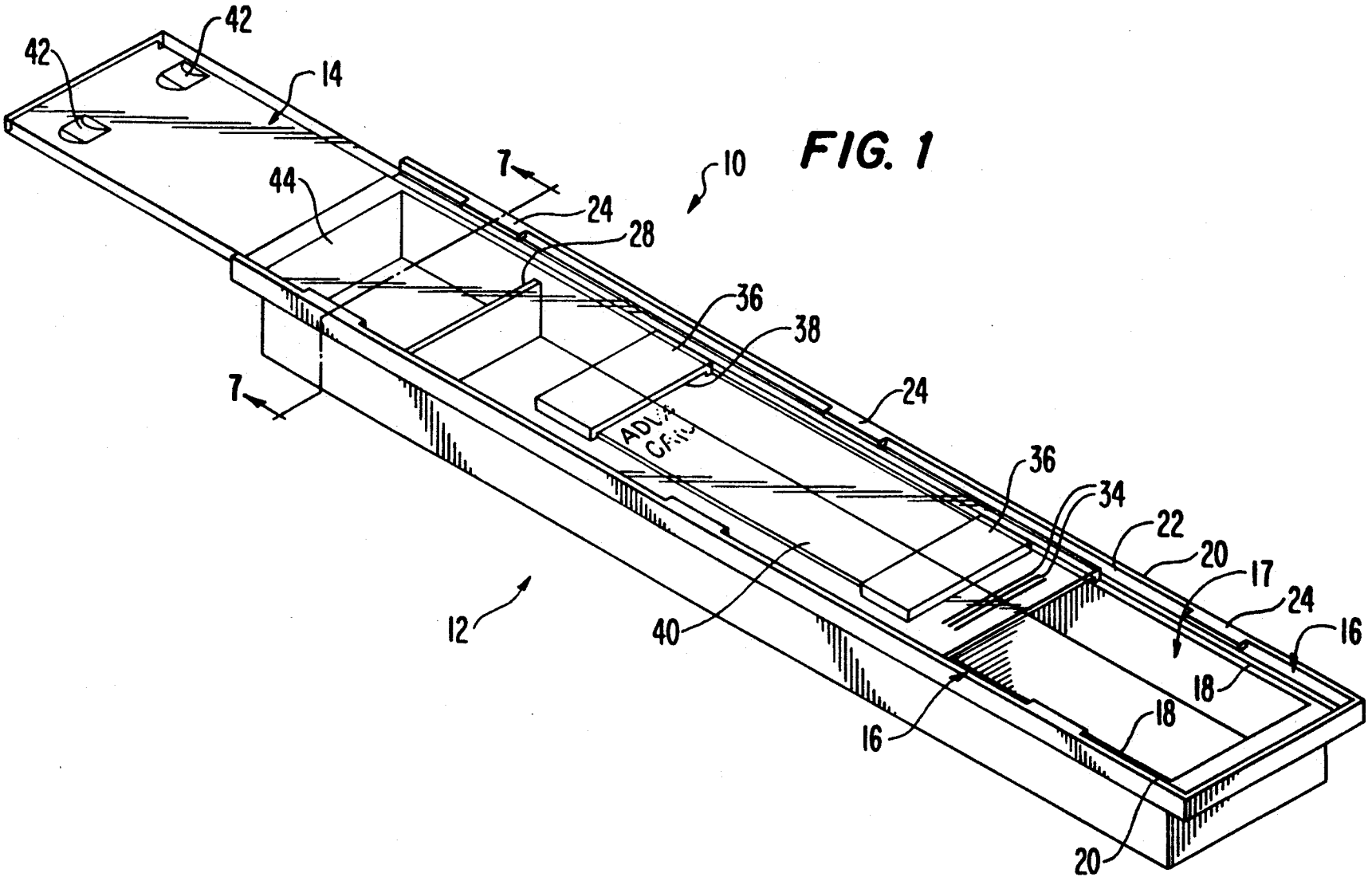
FIG. 1 is a perspective view of a medical dispenser according to the present invention.
Figure 2:
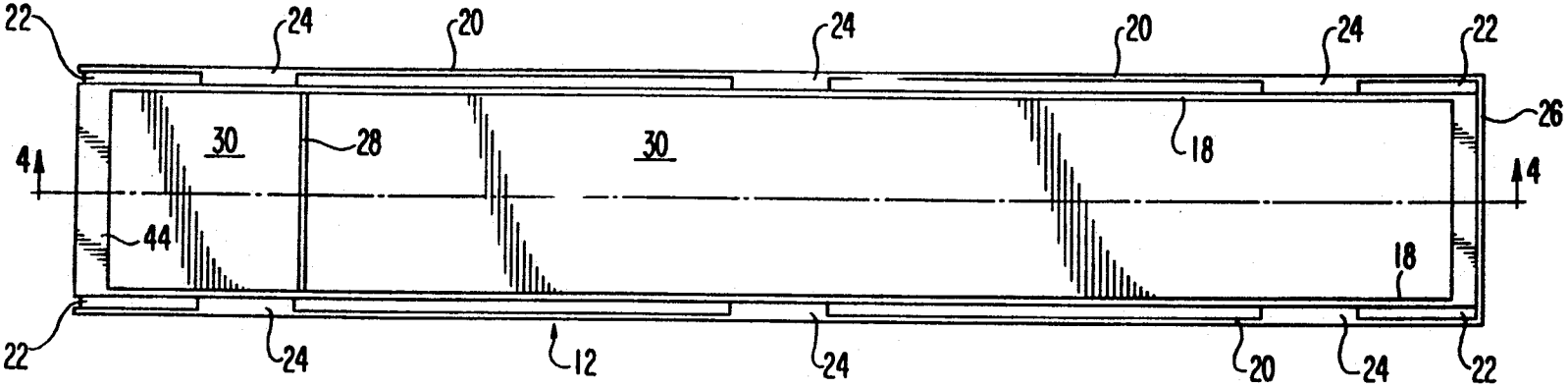
FIG. 2 is a plan view of a tray type container according to the present invention.
Figure 3:
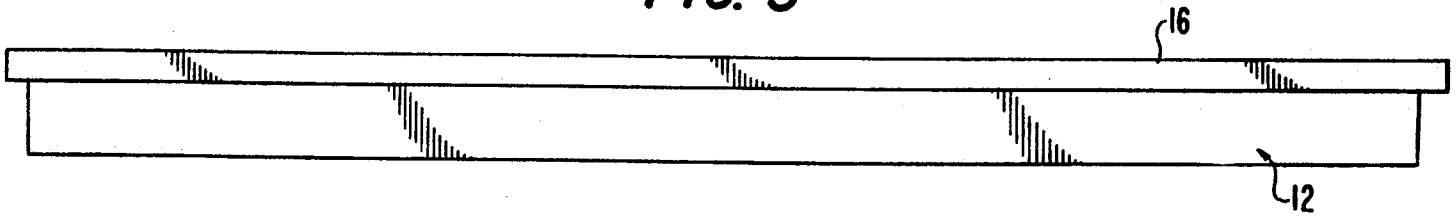
FIG. 3 is a side elevational view of the container of FIG. 2.
Figure 4:
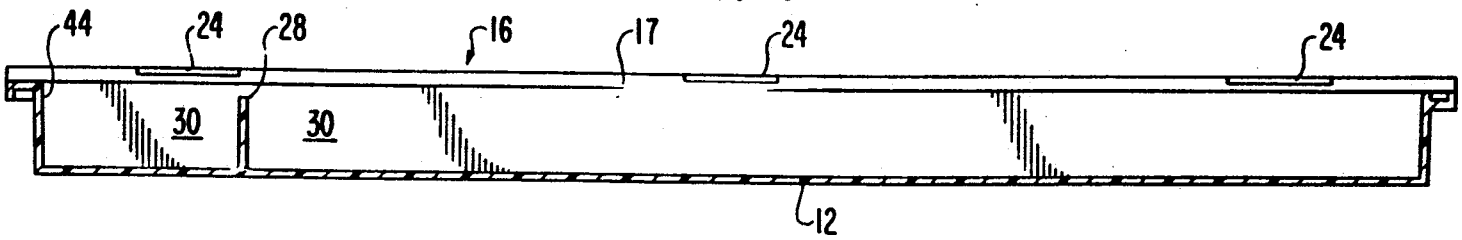
FIG. 4 is a cross-sectional view taken along the section line 4—4 appearing in FIG. 3.
Figure 5:
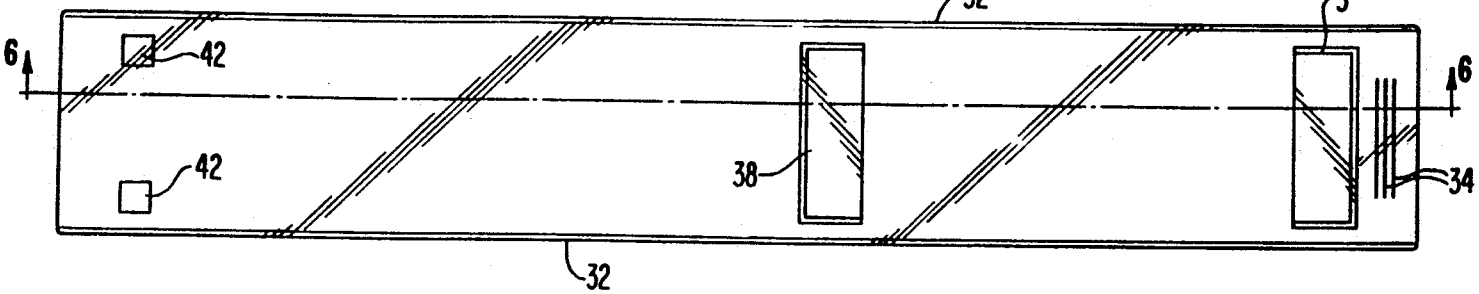
FIG. 5 is a plan view of a slide cover made according to the present invention.
Figure 6:
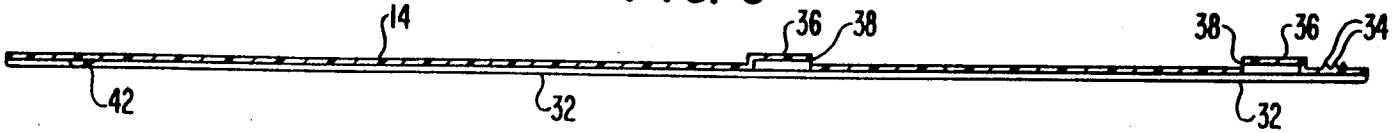
FIG. 6 is a cross-sectional view of the slide cover taken along the section line 6—6 appearing in FIG. 5.
Figure 8:
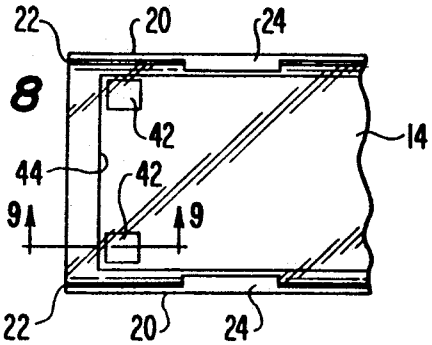
FIG. 8 is a fragmented end view of the dispenser.
Figure 9:
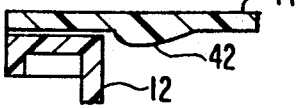
FIG. 9 is a cross-sectional view taken along section line 9—9 appearing in FIG. 8.

FIGS. 1-9 illustrate one embodiment of an improved medical dispenser 10 made in accordance with the principles of the present invention. As illustrated in FIGS. 1-4 and 7, the dispenser 10 includes a tray type container 12 and a cover 14 slidably cooperable with the container. The container 12 is formed of a suitable plastic material and is constructed in an elongated, generally parallelpiped construction. The container 12 includes guide or channel means 16 integrally formed along opposite longitudinal edges thereof, and defines an open top portion 17 which allows insertion and removal of the medical preparations (not shown). Each of the channel means 16 includes a pair of spaced apart inner and outer parallel walls 18, 20 which define a corresponding longitudinal channel 22. The outer channel walls 20 are raised relative to the inner channel walls 18 and are formed with a plurality of spaced cover retaining tabs 24. The tabs 24 are spaced over the channels 22 and cooperate with the sliding cover 14 for inhibiting removal of the latter. As best seen in FIGS. 1 and 2, each of the respective cover mounting channels 22 terminate in a retaining wall 26 which is constructed to limit inward sliding movement of the cover 14 relative to the container 12. The channels 22 are also formed with mouth portions which define an end which permits entry and removal of the cover relative to the container. The channels 22 are internal and therefore in contrast to previously known trays are not susceptible to bending or distortion which otherwise might interfere with an easy sliding movement of the cover.

The container 12 is provided with at least one partition 28 which defines separate storage chambers 30 within the container 12 that are adapted to receive tablets or other medical preparations that are (not shown) to be carried by the dispenser 10. The container 12 can be provided with a plurality of such partitions or other constructions.

Figure 7:
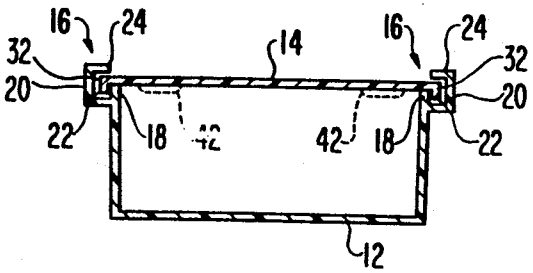
FIG. 7 is a cross-sectional end view taken along section line 7—7 appearing in FIG. 1.

Reference is now made to FIGS. 1 and 5-9 which illustrate the cover 14. In this embodiment, the cover 14 is in the form of a unitary, generally flat, and rectangular member made of transparent plastic and having a pair of depending edge means. Each edge means defines an integral depending lip portion 32 which is adapted to be slidably received within a channel 22 (FIG. 7). One end of the cover 14 is provided with a plurality of raised finger engaging projections 34 which facilitates the opening and closing of the cover 14. The cover 14 is provided with a pair of opposed raised projections 36 having apertures 38 therein which are generally facing each other. These raised projections 36 are intended to removably receive therein and retain a bendable or pliable, indicia bearing card 40 (FIG. 1) or the like which has opposite ends with tabs that are sized and shaped to be removably received by the apertures 38. The indicia card 40 when flexed in the middle can easily be inserted and removed from the cover. This facilitates reuse of the dispenser for a multiplicity of prescriptions.

With continued reference to FIGS. 1 and 5-9, the cover 14 is provided with a pair of detents 42 protruding from a bottom surface of the cover. The detents 42 are for engaging a rear wall portion 44 of the container 12 so as to limit opening movement of the cover 14 until the former are forced to ride over the wall portion 44.

Certain changes may be made in the above described dispenser without departing from the scope of the invention involved, and it is intended that all matter contained in the description thereof or shown in the accompanying drawing be interpreted as illustrative and not in a limiting sense.

What is claimed is:

1. A dispenser for storing and dispensing medical preparations; said dispenser comprising:

a container formed by a generally parallelpiped tray having an open top portion, and guide means formed at least along opposing marginal longitudinal sides adjacent said open top; and, a slidable cover having edge means for slidably cooperating with said guide means;

said cover includes a pair of generally longitudinally spaced apart and opposed projection means on a top surface thereof, said projection means are generally facing each other and defining recesses into which opposed cooperating ends of pliable indicia bearing member may be conveniently inserted, secured and replaced when desired with another such indicia bearing member and;

a pliable indicia bearing member removably secured within and by said recesses formed in said projection means.

2. The dispenser of claim 1 in which each of said projection means defines at least a raised projection with at least an aperture which removably receives the indicia member.

3. The dispenser of claim 1 wherein each of said guide means includes a pair of spaced apart channel defining walls which define an internal slide channel for slidably receiving said slidable edge means of said cover.

4. The dispenser of claim 2 wherein said cover includes detent means protruding from a bottom surface intermediate a longitudinal extent thereof for detenting cooperation with inner wall surfaces of walls defining said container so as to inhibit undesired removal of said cover.

5. The dispenser of claim 4 wherein said container defines walls for stopping sliding movement of said cover in one direction of sliding movement.

6. The dispenser of claim 1 wherein said spaced apart projection means comprise cooperating laterally disposed openings in said cover.

7. A dispenser for storing and dispensing medical preparations; said dispenser comprising:

a plastic container formed by a generally parallelpiped tray having an open top portion, and guide means formed at least along opposing marginal longitudinal sides adjacent said open top and defining an interval slide channel on each of said sides; and, a plastic slidable cover having edge means for slidably cooperating with said guide means along oppositely situated internal side channels;

said cover including a pair of generally longitudinally spaced apart and opposed projection means on a top surface thereof, said projection means generally facing each other and having recessed slots into which opposed cooperating ends of a pliable indicia bearing member may be conveniently inserted, secured and ultimately removed form the cover, to be replaced with a new indicia bearing member when appropriate, said cover further including detent means protruding from a bottom surface thereof for cooperation with a rear wall of said container so as to inhibit unintended sliding of the over from the container;

said spaced apart means for receiving opposed ends of a pliable indicia bearing means comprise cooperating laterally disposed openings in said cover.

8. The dispenser of claim 7 which further includes a pliable indicia bearing member removably secured between the slots formed in said projection means of the cover.

9. A dispenser for storing and dispensing medical preparations; said dispenser comprising:

a container formed by a generally parallelpiped tray having an open top portion, and guide means formed at least along opposing marginal longitudinal sides adjacent said open top; and, a slidable cover having edge means for slidably cooperating with said guide means;

said cover includes a pair of generally longitudinally spaced apart and opposed projection means on a top surface thereof, said projection means are generally facing each other and defining recesses into which opposed cooperating ends of pliable indicia bearing member may be conveniently inserted, secured and replaced when desired with another such indicia bearing member;

said cover includes detent means protruding from a bottom surface intermediate a longitudinal extent thereof for detenting cooperation with inner wall surfaces of walls defining said container so as to inhibit undesired removal of said cover.

* * * * *